US006641314B2

(12) United States Patent
Mogi

(10) Patent No.: US 6,641,314 B2
(45) Date of Patent: Nov. 4, 2003

(54) COLOR THERMAL PRINTER HAVING TENSION ROLLER

(75) Inventor: Shusuke Mogi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 68 days.

(21) Appl. No.: 10/092,496

(22) Filed: Mar. 8, 2002

(65) Prior Publication Data

US 2002/0124746 A1 Sep. 12, 2002

(30) Foreign Application Priority Data

Mar. 9, 2001 (JP) ..... 2001-067260

(51) Int. Cl.[7] ..... B41J 2/315

(52) U.S. Cl. ..... 400/120.01; 400/120.02; 400/124.05; 400/124.08; 400/124.09; 400/234; 400/618; 347/171; 347/172; 347/219; 347/220

(58) Field of Search ..... 400/120.01, 120.02, 400/124.05, 124.08, 124.09, 234, 618; 347/171, 172, 219, 220

(56) References Cited

U.S. PATENT DOCUMENTS 4,642,659 A * 2/1987 Nagashima et al. ..... 347/219
4,717,270 A * 1/1988 Tsutsumi ..... 400/120.04
4,723,853 A * 2/1988 Suzaki et al. ..... 400/120.16
4,771,296 A * 9/1988 Shimada et al. ..... 347/178
4,834,277 A * 5/1989 Gomoll et al. ..... 226/101
4,838,719 A * 6/1989 Une ..... 400/618
5,218,380 A * 6/1993 Fiscella ..... 346/136
5,647,679 A * 7/1997 Green et al. ..... 400/232
5,652,422 A * 7/1997 Shimaoka et al. ..... 235/475
5,711,620 A * 1/1998 Sasaki et al. ..... 400/120.02
5,847,742 A * 12/1998 Nishimura ..... 347/173
5,893,324 A * 4/1999 Kimura ..... 101/117
6,474,886 B1 * 11/2002 Sugiyama et al. ..... 400/634

* cited by examiner

*Primary Examiner*—Andrew H. Hirshfeld
*Assistant Examiner*—Andrea Hence Evans
(74) *Attorney, Agent, or Firm*—Sughrue Mion, PLLC

(57) ABSTRACT

A color thermal printer has a feed roller set, a thermal head, and a tension roller set that are serially arranged along a transporting path. The feed roller set and the tension roller set are rotated by respectively a stepping motor and a DC motor. The stepping motor rotates forwards. Simultaneously, the DC motor rotates the tension roller set forwards, to apply a first transporting force to the continuous recording sheet at a level higher than a predetermined transporting force of the feed roller set. Also, the stepping motor rotates backwards. Simultaneously, the DC motor rotates the tension roller set backwards, to apply a second transporting force to the continuous recording sheet at a level lower than the predetermined transporting force. A torque limiter applies load to the tension roller set relative to an output shaft of the DC motor, to keep the tension roller set rotated at a speed according to the predetermined transporting force simultaneously with application of the first or second transporting force to the continuous recording sheet. Thus, transport of the continuous recording sheet is stabilized according to a difference between the predetermined transporting force and the first or second transporting force.

24 Claims, 8 Drawing Sheets

COLOR THERMAL PRINTER HAVING TENSION ROLLER

BACKGROUND OF THE INVENTION

1. Field of the Invention

The present invention relates to a color thermal printer having a tension roller. More particularly, the present invention relates to a color thermal printer which has a tension roller, and in which transport of recording sheet can be equalized between an advance direction and a return direction, to raise a speed of printing.

2. Description Related to the Prior Art

A color thermal printer is known, in which a roll of continuous color thermosensitive recording sheet is used. A thermal head is used to record an image with pressure and heat to the continuous recording sheet being transported. Images of three primary colors are recorded in a frame-sequential recording, to obtain a full-color print. To shorten the printing time in the color thermal printer, the continuous recording sheet can be transported back and forth. A first one of the colors is recorded in the transport in the advance direction. A second one of the colors is recorded in the transport in the return direction. A third one of the colors is recorded in the transport in the forward direction for a second time.

To transport the continuous recording sheet back and forth with respect to the thermal head, there is a known structure in which a platen roller is opposed to the thermal head, disposed to receive a back surface of the continuous recording sheet, and caused to rotate for transporting the continuous recording sheet. However, the platen roller is produced from rubber, and is difficult to transport the continuous recording sheet with high precision due to influences of micro slips or the like. Shifts in registration of the colors may occur. Therefore, at least one feed roller set including a pair of two rollers is used for transporting the continuous recording sheet. In the feed roller set, there are a capstan roller and a pinch roller for being pressed against the continuous recording sheet to squeeze the continuous recording sheet between the same and the capstan roller. Furthermore, two feed roller sets may be used, and disposed in positions upstream and downstream from the thermal head. A first one of the feed roller sets operates to transport the continuous recording sheet in the advance direction. A second one of the feed roller sets operates to transport the continuous recording sheet in the return direction.

If the feed roller set for transport in the advance direction is different from the feed roller set for transport in the return direction, it is difficult to transport the continuous recording sheet at an equal amount between the two directions. This causes a problem of shifts in the registration of the colors.

Furthermore, the single structure of the feed roller set may be used for the continuous recording sheet in the advance and return directions. However, tension applied by the feed roller set to the continuous recording sheet changes between the two directions. So unwanted changes occur in the transporting amount of the continuous recording sheet.

SUMMARY OF THE INVENTION

In view of the foregoing problems, an object of the present invention is to provide a color thermal printer which has a tension roller, and in which transport of recording sheet can be equalized between an advance direction and a return direction, to raise a speed of printing.

In order to achieve the above and other objects and advantages of this invention, a color thermal printer for recording at least three color images to thermosensitive recording material according to frame sequential recording is provided. A feed roller set transports the recording material at a first speed back and forth by transport in first and second directions alternately. A thermal head is positioned downstream from the feed roller set in the first direction, for recording the three color images according to the transport in both the first and second directions. A first tension roller set is positioned downstream from the thermal head in the first direction, for applying tension to the recording material. A first tension motor drives the first tension roller set. A controller controls a rotational speed of the first tension motor, determines a transporting speed of the recording material with the first tension roller set higher than the first speed in the transport in the first direction, and determines a transporting speed of the recording material with the first tension roller set lower than the first speed in the transport in the second direction. A first torque limiter adjusts transmission of rotation of the first tension motor to the first tension roller set, to keep a transporting speed of the recording material with the first tension roller set at the first speed during the transport in the first and second directions.

To be precise, a color thermal printer has a thermal head for thermal recording to recording material. There is a feeding motor. At least one feed roller is positioned upstream from the thermal head as viewed in an advance direction, caused by the feeding motor to rotate forwards, for transporting the recording material in the advance direction by applying a predetermined transporting force thereto, and also caused by the feeding motor to rotate backwards, for transporting the recording material in the return direction by applying the predetermined transporting force thereto. At least one first tension roller is positioned downstream from the thermal head as viewed in the advance direction, for frictionally contacting the recording material. A first tension motor rotates the first tension roller forwards and backwards. A controller drives the feeding motor in a forward direction, and simultaneously causes the first tension motor to rotate the first tension roller forwards, to apply a first transporting force to the recording material, the first transporting force being higher than the predetermined transporting force, the controller drives the feeding motor in a backward direction, and simultaneously causes the first tension motor to rotate the first tension roller backwards, to apply a second transporting force to the recording material, the second transporting force being lower than the predetermined transporting force. A torque limiter is secured between an output shaft of the first tension motor and the first tension roller in a slippable manner, for applying load to one of the output shaft and the first tension roller relative to a remaining one thereof, to keep the first tension roller rotated at a rotational speed adjusted according to the predetermined transporting force simultaneously with application of the first or second transporting force to the recording material, transport of the recording material being stabilized according to a difference between the predetermined transporting force and the first or second transporting force.

In a preferred embodiment, the at least one first tension roller comprises two rollers for nipping the recording material.

The feeding motor is a stepping motor, the predetermined transporting force is predetermined according to a period of the thermal recording of the thermal head by one line. The first tension motor is a DC motor.

The thermal head records at least first, second and third colors to the recording material in frame-sequential recording, transport of the recording material in the advance direction is used for recording the first color, and transport of the recording material in the return direction is used for recording the second color.

The predetermined transporting force is higher than load applied by the thermal head to the recording material in the thermal recording. The torque limiter is operated in the thermal recording to provide the load.

Furthermore, at least one second tension roller is positioned upstream from the feed roller as viewed in the advance direction, for frictionally contacting the recording material. A second tension motor rotates the second tension roller forwards. Simultaneously with driving of the feeding motor in the forward direction, the controller further causes the second tension motor to rotate the second tension roller forwards, to apply a third transporting force to the recording material, the third transporting force being lower than the predetermined transporting force. The first and third transporting forces are so predetermined as to provide equilibrium of a difference between the first and predetermined transporting forces to a difference between the third and predetermined transporting forces.

The first tension roller includes a roller body. A cylindrical holder chamber is formed in the roller body. A transmission shaft is inserted in the holder chamber, for being rotated by the first tension motor. The torque limiter applies the load to one of the transmission shaft and the roller body relative to a remaining one thereof.

The torque limiter includes a housing, disposed in the holder chamber, and having a ring chamber inside. A first retention mechanism retains the housing in the holder chamber. An inner ring is disposed in the ring chamber, for receiving insertion of the transmission shaft. A second retention mechanism retains the inner ring on the transmission shaft. A coil spring applies the load frictionally to one of the housing and the inner ring relative to a remaining one thereof.

The first retention mechanism includes a groove formed in an inner wall of the holder chamber. A projection is formed to project from the housing, for engagement with the groove.

The second retention mechanism includes a pin formed to project from the transmission shaft. A notch is formed in the inner ring, for engagement with the pin.

According to another preferred embodiment, a feed roller set transports the recording material at a first speed back and forth by transport in first and second directions alternately. A thermal head is positioned downstream from the feed roller set in the first direction, for recording the three color images according to the transport in both the first and second directions. A platen roller supports the recording material pressed by the thermal head. A platen motor drives the platen roller. A controller controls a rotational speed of the platen motor, determines a transporting speed of the recording material with the platen roller higher than the first speed in the transport in the first direction, and determines a transporting speed of the recording material with the platen roller lower than the first speed in the transport in the second direction. A first torque limiter adjusts transmission of rotation of the platen motor to the platen roller, to keep a transporting speed of the recording material with the platen roller at the first speed during the transport in the first and second directions.

According to still another preferred embodiment, a feed roller set transports the recording material at a first speed back and forth by transport in first and second directions alternately. A thermal head is positioned downstream from the feed roller set in the first direction, for recording the three color images according to the transport in both the first and second directions. A first tension roller set is positioned downstream from the thermal head in the first direction, for applying tension to the recording material. A first tension motor drives the first tension roller set, a rotational speed of the first tension motor being changeable with an increase or decrease according to a transporting speed of the recording material. A second tension roller set is positioned upstream from the feed roller set in the first direction, for applying tension to the recording material. A second tension motor drives the second tension roller set, a rotational speed of the second tension motor being changeable with an increase or decrease according to a transporting speed of the recording material. A controller controls the rotational speeds of the first and second tension motors. In a first process of the transport in the first direction, the controller adjusts the rotational speed of the first tension motor to determine a transporting speed of the recording material with the first tension roller set higher than the first speed, and adjusts the rotational speed of the second tension motor to determine a transporting speed of the recording material with the second tension roller set lower than the first speed, the first tension roller set creates forward tension to pull the recording material in the first direction, the second tension roller set creates back tension to pull the recording material in the second direction, the back tension is substantially equal to the forward tension. In a second process of the transport in the second direction, the controller adjusts the rotational speed of the first tension motor to determine a transporting speed of the recording material with the first tension roller set lower than the first speed, and adjusts the rotational speed of the second tension motor to determine a transporting speed of the recording material with the second tension roller set higher than the first speed, the second tension roller set creates forward tension to pull the recording material in the second direction, the first tension roller set creates back tension to pull the recording material in the first direction, the back tension is substantially equal to the forward tension.

To be precise, a color thermal printer includes a thermal head for thermal recording to recording material. There is a feeding motor. At least one feed roller is positioned upstream from the thermal head as viewed in an advance direction, caused by the feeding motor to rotate forwards, for transporting the recording material in the advance direction by applying a predetermined transporting force thereto. At least one first tension roller is positioned downstream from the thermal head as viewed in the advance direction, for frictionally contacting the recording Material. At least one second tension roller is positioned upstream from the feed roller as viewed in the advance direction, for frictionally contacting the recording material. First and second tension motors rotate respectively the first and second tension rollers forwards. A controller drives the feeding motor in a forward direction, and simultaneously rotates the first tension roller forwards by providing the first tension motor with first energy, to apply first transporting force to the recording material, the first transporting force being higher than the predetermined transporting force, and also simultaneously rotates the second tension roller forwards by providing the second tension motor with second energy, to apply second transporting force to the recording material, the second transporting force being lower than the predetermined transporting force. The first and second energies are so predetermined as to provide equilibrium of a difference between the first and predetermined transporting forces to a difference between the second and predetermined transporting forces.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
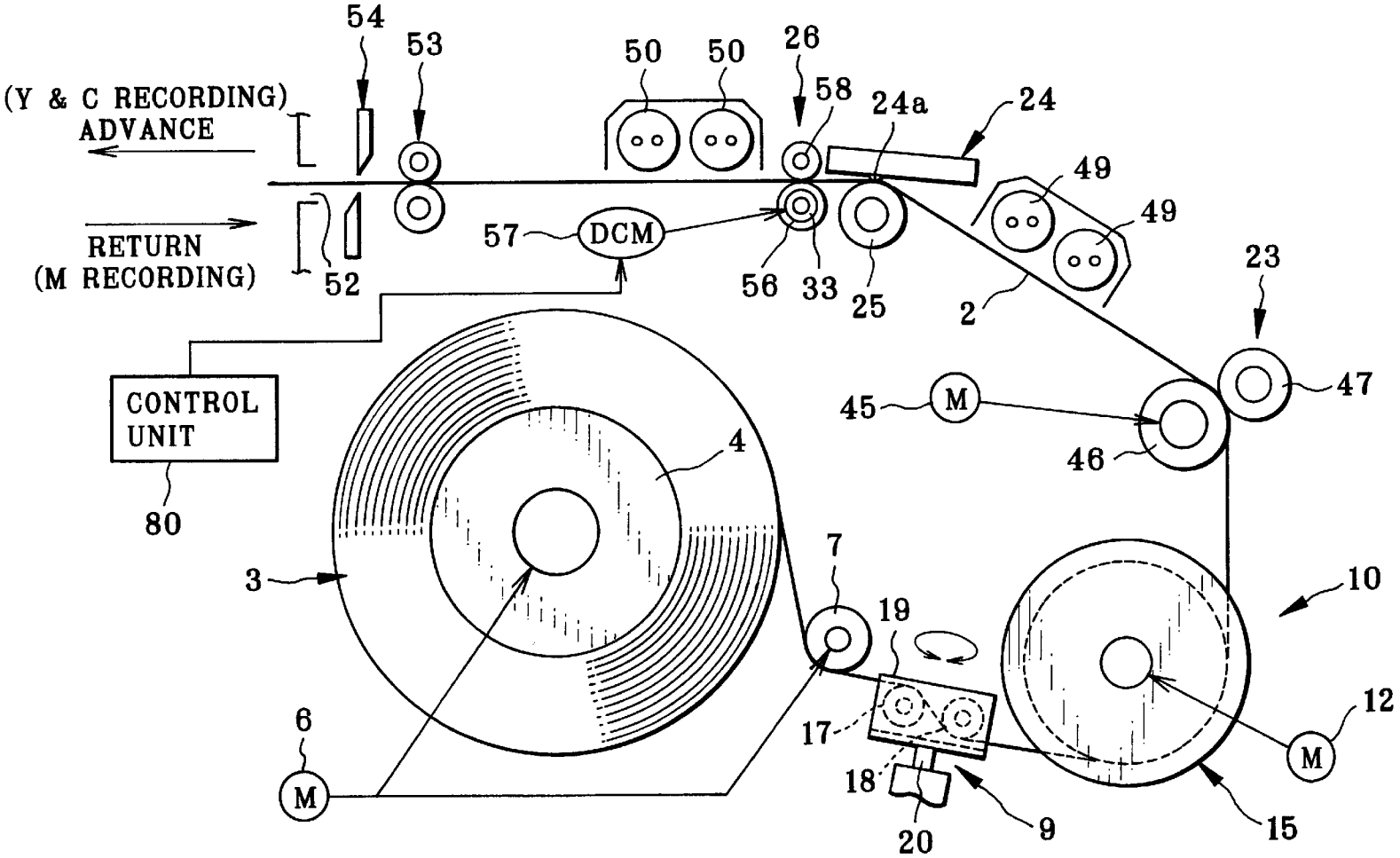
FIG. 1 is an explanatory view illustrating a color thermal printer of the invention.

In FIG. 1, a color thermal printer of the invention is illustrated. Continuous color thermosensitive recording sheet 2 is used as recording material. A recording sheet roll 3 is initially supplied as the continuous recording sheet 2. Paper holders 4 are fitted on ends of the recording sheet roll 3, which is set in a roll holder station of the color thermal printer.

A stepping motor 6 causes the paper holders 4 to rotate, so the recording sheet roll 3 in the roll holder station is rotated in a return direction of winding the continuous recording sheet 2 back to the recording sheet roll 3. A feed roller 7 is also rotated by the stepping motor 6, and transports the continuous recording sheet 2 from the recording sheet roll 3 in an advance direction.

As is well-known in the art, the continuous recording sheet 2 includes a support, and cyan, magenta and yellow thermosensitive coloring layers overlaid thereon. The yellow coloring layer is positioned the farthest from the support, has the highest thermosensitivity, and develops yellow color in response to small heat energy. The cyan coloring layer is positioned the nearest to the support, has the lowest thermosensitivity, and develops cyan color in response to great heat energy. Also, the coloring ability of the yellow coloring layer is destroyed when near ultraviolet rays with a wavelength of 420 nm is applied to the same. The magenta coloring layer develops magenta color in response to middle heat energy between the minimum and maximum. The coloring ability of the magenta coloring layer is destroyed when ultraviolet rays with a wavelength of 365 nm is applied to the same. It is to be noted that the continuous recording sheet 2 may have a four-layer structure including a black coloring layer in addition to the above three coloring layers.

Figure 2:
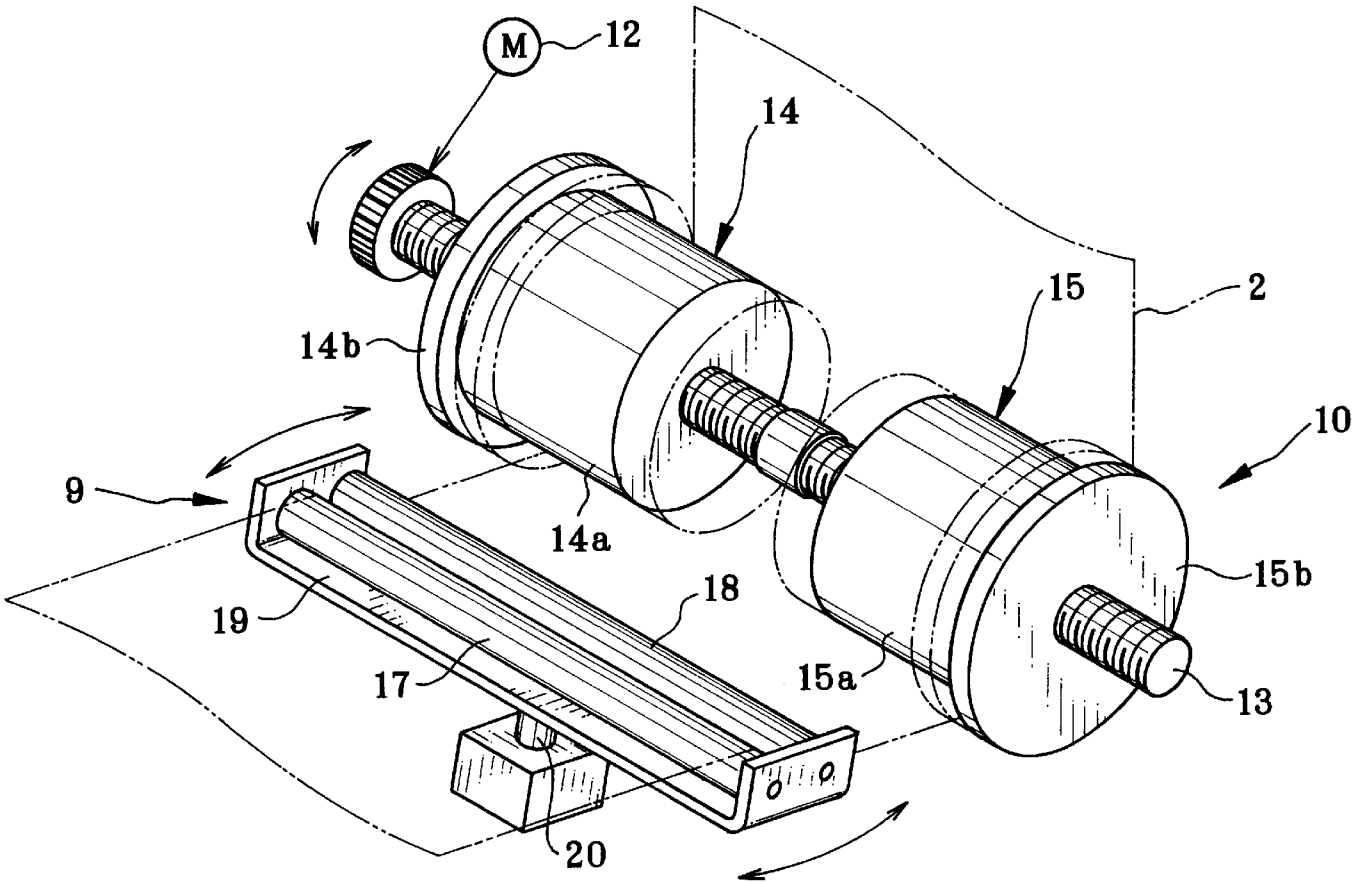
FIG. 2 is a perspective illustrating a guide roller unit and a regulator mechanism.

A guide roller unit 9 and a regulator mechanism 10 are disposed in a downstream position as viewed from the feed roller 7. In FIG. 2, the regulator mechanism 10 includes a lead screw 13 and regulation rollers 14 and 15. The lead screw 13 is rotated by a stepping motor 12. The regulation rollers 14 and 15 have female threads helically engaged with the lead screw 13. The regulation roller 14 includes a roller body 14*a* and a regulation disk 14*b*. The roller body 14*a* supports a back surface of the continuous recording sheet 2. The regulation disk 14*b* contacts a lateral edge of the continuous recording sheet 2, and regulates the orientation of the continuous recording sheet 2 in the width direction. Similarly, the regulation roller 15 includes a roller body 15*a* and a regulation disk 15*b*.

The lead screw 13 has two portions which are defined by the central position, and have threads of directions opposite to one another. When the lead screw 13 rotates in the clockwise direction, the regulation rollers 14 and 15 move toward the center of the lead screw 13. As the continuous recording sheet 2 is contacted by the roller bodies 14*a* and 15*a* of the regulation rollers 14 and 15, lateral edges of the continuous recording sheet 2 are pressed by the regulation disks 14*b* and 15*b*, to compensate for shifts of the continuous recording sheet 2 in the width direction. When the lead screw 13 is rotated in the counterclockwise direction, the regulation rollers 14 and 15 are moved toward respectively ends of the lead screw 13.

The guide roller unit 9 includes guide rollers 17 and 18, a bracket 19 and a support 20. The guide rollers 17 and 18 contact the continuous recording sheet 2 in such a manner that the continuous recording sheet 2 travels in an S shape. The bracket 19 supports the guide rollers 17 and 18 in a rotatable manner. The support 20 supports the bracket 19 in a rotatable manner about a vertical axis. The guide roller unit 9 is finely rotated by use of the support 20 according to a twisted state of the continuous recording sheet 2 created by the regulation of the regulator mechanism 10 in the width direction. The twisted state of the continuous recording sheet 2 is absorbed, to prevent the continuous recording sheet 2 from being bent, flexed, or jammed.

There are a feed roller set 23, a thermal head 24 with a platen roller 25, and a tension roller set 26 arranged in the advance direction from the regulator mechanism 10. The tension roller set 26 includes a capstan roller or tension roller 56 and a pinch roller 58. The capstan roller 56 is rotated by a DC motor 57 as tension motor. The pinch roller 58 is pressed toward the capstan roller 56, and squeezes the continuous recording sheet 2. A shifting mechanism (not shown) shifts the pinch roller 58, and includes a cam, spring, solenoid and the like. The pinch roller 58, when in a first position, is pressed to the capstan roller 56, and when in a second position, comes away from the capstan roller 56.

Figure 3:
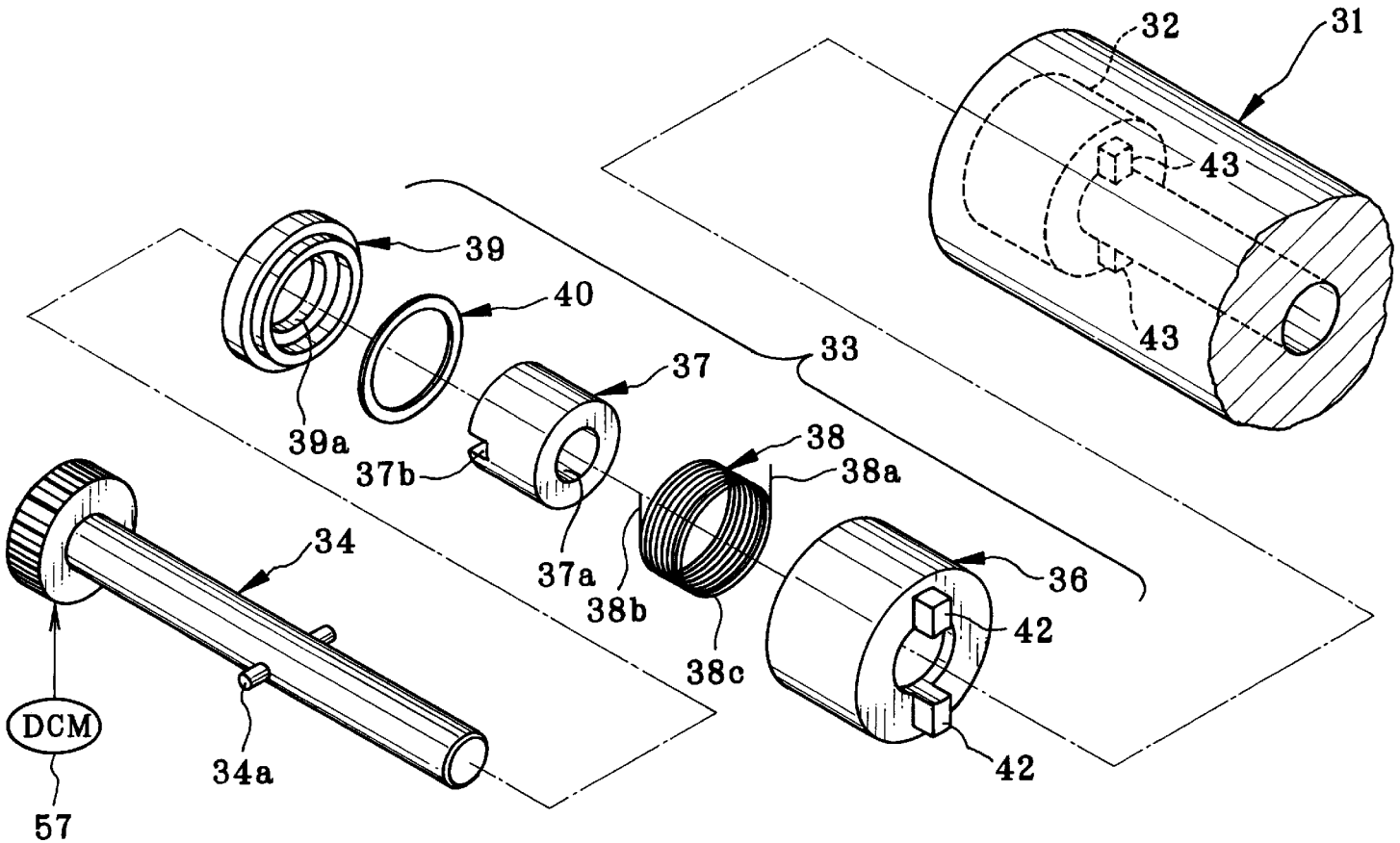
FIG. 3 is an exploded perspective illustrating a capstan roller included in a tension roller set.

In FIG. 3, the capstan roller 56 in the tension roller set 26 includes a roller body 31, a torque limiter 33 and a transmission shaft 34. The roller body 31 contacts the continuous recording sheet 2. The torque limiter 33 is inserted in a holder chamber 32 formed in an end portion of the roller body 31. The transmission shaft 34 transmits rotation of the DC motor 57 to the torque limiter 33. A remaining end of the roller body 31 is supported by a rotational shaft fixed on the roller body 31.

The torque limiter 33 includes a housing 36, an inner ring 37, a coil spring or coil 38, a shield ring 39 and a spacer 40. The housing 36 is cylindrical. The inner ring 37 is inserted in the housing 36 in a rotatable manner. The coil spring 38 is positioned between the housing 36 and the inner ring 37. Two spring ends 38*a* and 38*b* of the coil spring 38 are secured to the inside of the housing 36. A coil portion 38*c* of the coil spring 38 tightly holds the inner ring 37. The shield ring 39 closes a rear end opening of the housing 36. The spacer 40 adjusts a position of the coil spring 38.

A hole 39*a* is defined inside the shield ring 39, and receives insertion of the transmission shaft 34 for entry to the torque limiter 33. An inner gap 37*a* is defined inside the inner ring 37. The transmission shaft 34 is inserted in the inner gap 37*a* in a lightly fitted manner. Retention notches 37*b* are formed in the inner ring 37. Retention pins 34*a* protrude from the transmission shaft 34, and engaged with the retention notches 37*b*. Retention projections 42 project from an end face of the housing 36. Retention grooves 43 are formed in an inner wall of the holder chamber 32 of the roller body 31, for engagement with the retention projections 42. Note that grease or other lubricant agent is enclosed in the torque limiter 33.

As rotation of the DC motor 57 is transmitted to the transmission shaft 34, rotation of the transmission shaft 34 is transmitted to the inner ring 37 by engagement of the retention pins 34*a* and the retention notches 37*b*. The rotation of the inner ring 37 is transmitted by the coil spring 38 to the housing 36, of which rotation is transmitted to the roller body 31 by engagement of the retention projections 42 and the retention grooves 43. When load is applied to the roller body 31, the inner ring 37 slips relative to the coil spring 38. The transmission shaft 34 rotates in a racing manner relative to the roller body 31.

Load at which the torque limiter 33 operates is predetermined higher than load created when the thermal head 24 prints an image to the continuous recording sheet 2. In the course of printing, the torque limiter 33 does not operate, so that the DC motor 57 does not rotate separately from the roller body 31.

The feed roller set 23 includes a capstan roller 46 and a pinch roller 47. The capstan roller 46 is rotated by a stepping motor 45. The pinch roller 47 is pressed toward the capstan roller 46, and squeezes the continuous recording sheet 2. A shifting mechanism (not shown) shifts the pinch roller 47, and includes a cam, spring, solenoid and the like. The pinch roller 47, when in a first position, is pressed to the capstan roller 46, and when in a second position, comes away from the capstan roller 46. The feed roller set 23 transports the continuous recording sheet 2 in a regular speed.

While the continuous recording sheet 2 is transported in the advance direction, the DC motor 57 for the tension roller set 26 rotates in such a manner that a circumferential speed of the tension roller set 26 is higher than a circumferential speed of the feed roller set 23. When the continuous recording sheet 2 rotates in the return direction, the DC motor 57 rotates in such a manner that the circumferential speed of the tension roller set 26 is lower than the circumferential speed of the feed roller set 23. Therefore, no difference in the color registration occurs, because the feed roller set 23 determines the transporting speed of the continuous recording sheet 2 in both directions of the advance and return. The DC motor 57 is caused to rotated in a racing manner by means of the torque limiter 33. Consequently, no breakage of the continuous recording sheet 2 occurs while back tension can be applied.

A heating element array 24*a* in the thermal head 24 includes a train of numerous heating elements, and fixed in a printer. The platen roller 25 is opposed to the thermal head 24 to squeeze the continuous recording sheet 2. The platen roller 25 is kept movable in upward and downward directions. A shifting mechanism (not shown) shifts the platen roller 25, and includes a cam, spring, solenoid and the like. The platen roller 25, when in an effective position, is pressed to the thermal head 24, and when in an ineffective position, comes away from the thermal head 24.

While the continuous recording sheet 2 is transported, the heating element array 24*a* in the thermal head 24 develops heat at intended temperature, to color the coloring layers in the continuous recording sheet 2. The platen roller 25 is rotated by following the movement of the continuous recording sheet 2.

A magenta fixing ultraviolet lamp 49 is disposed between the feed roller set 23 and the thermal head 24. A yellow fixing ultraviolet lamp 50 is disposed downstream from the tension roller set 26. The yellow fixing ultraviolet lamp 50 emits near ultraviolet rays of which a wavelength of a peak is 420 nm. The magenta fixing ultraviolet lamp 49 emits ultraviolet rays of which a wavelength of a peak is 365 nm. The fixing ultraviolet lamps 49 and 50 fix the magenta and yellow coloring layer in the continuous recording sheet 2 by destroying ability of developing colors.

There are ejector rollers 53 and a cutter 54 disposed downstream from the yellow fixing ultraviolet lamp 50 in the advance direction. The ejector rollers 53 eject the recording sheet 2 through a passage opening 52 after the image recording. The cutter 54 cuts the continuous recording sheet 2 into separate sheets in predetermined positions.

Figure 4:
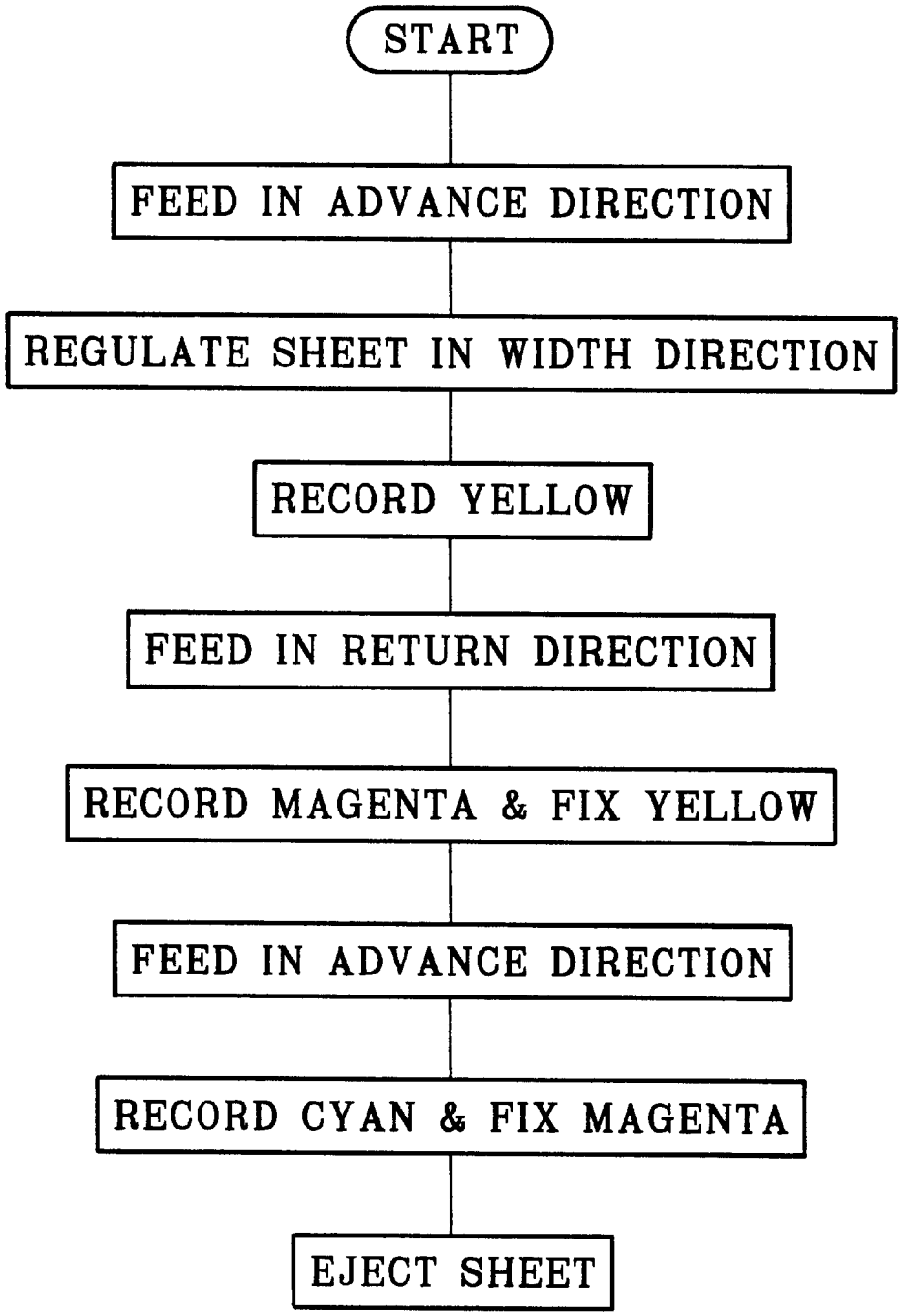
FIG. 4 is a flow chart illustrating operation of printing.

The operation of the above embodiment is described. See FIG. 4. Printing operation is started in the color thermal printer of FIG. 2. The stepping motor 6 starts rotation. The rotation is transmitted to the paper holders 4 and the feed roller 7, so the continuous recording sheet 2 is transported in the advance direction.

At the time of starting printing, the pinch rollers 47 and 58 in the feed roller set 23 and the tension roller set 26 are positioned away from the capstan rollers 46 and 56 by shifting mechanisms. Also, the platen roller 25 is positioned away from the thermal head 24. In the regulator mechanism 10, the regulation rollers 14 and 15 are set at the ends of the lead screw 13. A distance between the regulation disks 14*b* and 15*b* is set longer than the width of the continuous recording sheet 2. Therefore, a path of transporting the continuous recording sheet 2 inside the thermal printer is kept open.

The continuous recording sheet 2 is passed between the guide rollers 17 and 18 in the guide roller unit 9 in the S shape, and comes to contact the roller bodies 14*a* and 15*a* of the regulation rollers 14 and 15 in the regulator mechanism 10. When the continuous recording sheet 2 passes the feed roller set 23, a sensor (not shown) detects a leading edge of the continuous recording sheet 2.

When a front edge of the continuous recording sheet 2 is detected, the stepping motor 6 is stopped from transporting the continuous recording sheet 2. The stepping motor 12 in the regulator mechanism 10 starts rotation. In FIG. 2, the stepping motor 12 rotates the lead screw 13 in the clockwise direction, to move the regulation rollers 14 and 15 toward the center of the lead screw 13. The regulation rollers 14 and 15 are so set that an interval between the regulation disks 14*b* and 15*b* is equal to a prescribed width of the continuous recording sheet 2. During the movement of the regulation rollers 14 and 15, the regulation disks 14*b* and 15*b* push lateral edges of the continuous recording sheet 2, and regulate orientation of the continuous recording sheet 2 in the width direction.

A twisted state of the continuous recording sheet 2 caused by a shift in the width direction is absorbed by a minute swing of the bracket 19 in the guide roller unit 9 about the support 20. Therefore, no fold, bend or jam of the continuous recording sheet 2 occurs upon occurrence of the twisted state of the continuous recording sheet 2.

When the regulating operation in the width direction of the continuous recording sheet 2 is completed, then the stepping motor 12 is stopped. A shifting mechanism for the feed roller set 23 is actuated, to squeeze the continuous recording sheet 2 by shifting the pinch roller 47 toward the capstan roller 46. Therefore, the continuous recording sheet 2 is transported in the advance direction in the regulated state without unwanted shifts in the width direction.

When the stepping motor 45 operates, the capstan roller 46 is rotated, to transport the continuous recording sheet 2 in the advance direction. Note that an amount of transporting the continuous recording sheet 2 is measured according to an amount of rotation of the pinch roller 47. The continuous recording sheet 2 is passed between the thermal head 24 and the platen roller 25, and transported to a position of the tension roller set 26. When a front end of the continuous recording sheet 2 is found to have passed the tension roller set 26 according to the number of rotations of the pinch roller 47 of the feed roller set 23, then the stepping motor 45 is stopped to rotate. Transport of the continuous recording sheet 2 is stopped.

After the stop of the transport, the shifting mechanism is actuated to squeeze the continuous recording sheet 2 between the pinch roller 58 and the capstan roller 56 in the tension roller set 26. At the same time, the shifting mechanism for the platen roller 25 is actuated. The continuous recording sheet 2 is squeezed between the thermal head 24 and the platen roller 25 shifted up.

Then the DC motor 57 and the stepping motor 45 are driven, to cause the tension roller set 26 and the feed roller set 23 to transport the continuous recording sheet 2 in the advance direction. In the transport, the tension roller set 26 is supplied with such torque as to rotate at a higher circumferential speed than a circumferential speed of the feed roller set 23. In spite of this torque, the tension roller set 26 rotates at the circumferential speed of the feed roller set 23 to transport the continuous recording sheet 2 regularly, because the DC motor 57 is caused to operate in a racing manner by the torque limiter 33 which creates slips between the capstan roller 56 and an output shaft of the DC motor 57.

When a front edge of a recording region of the continuous recording sheet 2 in the advancing direction reaches the thermal head 24, then the heating element array 24*a* is driven. A yellow image is recorded to the yellow coloring layer one line after another by application of heat.

After the yellow image finishes being recorded to a rear end position of a recording region in the continuous recording sheet 2, the rear end position is moved to become opposed to the yellow fixing ultraviolet lamp 50. Then the stepping motor 45 and the DC motor 57 are stopped.

Then the stepping motor 45, the stepping motor 6 and the DC motor 57 are caused to rotate in reverse to the initial direction, to transport the continuous recording sheet 2 in the return direction. In the transport in the return direction, the tension roller set 26 is supplied with such torque as to rotate at a lower circumferential speed than a circumferential speed of the feed roller set 23.

The torque limiter 33 at the tension roller set 26 creates slips to allow the DC motor 57 to rotate in a racing manner. Therefore, tension is applied to the continuous recording sheet 2 in a portion downstream from the feed roller set 23. Tightness in the contact of the continuous recording sheet 2 with the feed roller set 23 is raised, to stabilize the transport.

At the same time as the continuous recording sheet 2 is transported in the return direction, the yellow fixing ultraviolet lamp 50 is turned on to fix the yellow coloring layer in the recording region of the continuous recording sheet 2. When an end of the recording region disposed in the return direction reaches the thermal head 24, then the heating element array 24*a* is driven, to heat the recording region to record a magenta image one line after another to the magenta coloring layer. Consequently, no shift in the registration occurs between the yellow and magenta images, because the speed of the continuous recording sheet 2 can be exactly determined by operation of the feed roller set 23 in the advance and return directions.

After the magenta image finishes being recorded to a rear end position of a recording region in the continuous recording sheet 2, the rear end position is moved to become opposed to the magenta fixing ultraviolet lamp 49. Then the stepping motor 45, the stepping motor 6 and the DC motor 57 are stopped. After this, the stepping motor 45 and the DC motor 57 are restarted. The tension roller set 26 rotates at the circumferential speed of the feed roller set 23 to transport the continuous recording sheet 2 in the advance direction while the torque limiter 33 operates for slip between the capstan roller 56 and the output shaft of the DC motor 57.

At the same time as the continuous recording sheet 2 is transported in the advance direction, the magenta fixing ultraviolet lamp 49 is turned on to fix the magenta coloring layer in the recording region of the continuous recording sheet 2. When the front end of the recording region disposed in the advance direction reaches the thermal head 24, then the heating element array 24*a* is driven, to heat the recording region to record a cyan image one line after another to the cyan coloring layer. Consequently, no shift in the registration occurs between the cyan color and the two other colors, because the speed of the continuous recording sheet 2 can be exactly determined by operation of the feed roller set 23 in both directions.

After the cyan image finishes being recorded up to a rear end position of a recording region in the continuous recording sheet 2, then the stepping motor 6 and the DC motor 57 are stopped. The platen roller 25 is moved to the lower ineffective position. After this, the stepping motor 45 and the DC motor 57 are restarted to transport the continuous recording sheet 2 in the advance direction. The continuous recording sheet 2 is exited through the passage opening 52. There is no fixing operation of the cyan coloring layer, because the layer is not provided with optical fixability.

When a portion of the continuous recording sheet 2 after image printing comes out of the printer, then the stepping motor 45 and the DC motor 57 are stopped. The cutter 54 is actuated to cut the continuous recording sheet 2, to obtain a sheet-shaped color print. It is possible in the invention to obtain the color print with high quality without shift of registration of the colors, or without white streaks or black streaks. If no other print is desired after this, then the continuous recording sheet 2 is transported in the return direction, and wound back to the recording sheet roll 3 and kept from moisture or high humidity.

Figure 5:
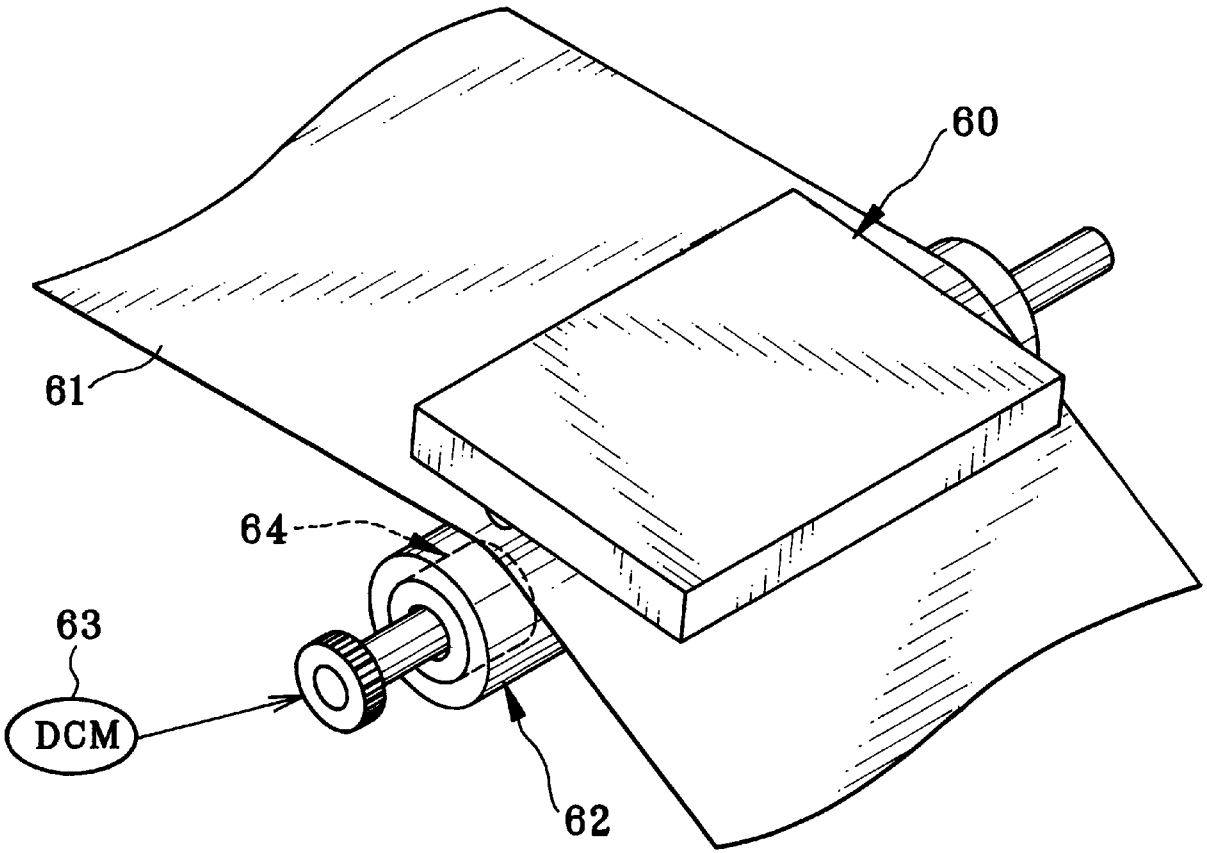
FIG. 5 is a perspective illustrating another preferred thermal printer in which a torque limiter is combined with a platen roller.

In the above embodiment, the pairs of tension rollers are used. In FIG. 5, another preferred embodiment is illustrated, in which a torque limiter 64 is combined with a platen roller 62. A thermal head 60 is opposed to the platen roller 62. Continuous color thermosensitive recording sheet 61 as recording material is passed between and squeezed by the thermal head 60 and the platen roller 62. A DC motor 63 as platen motor has an output shaft connected with the platen roller 62 by the torque limiter 64, and rotates the platen roller 62 while the torque limiter 64 transmits the rotation. The platen roller 62 transports the continuous recording sheet 61 and applies back tension to the continuous recording sheet 61.

Figure 6:
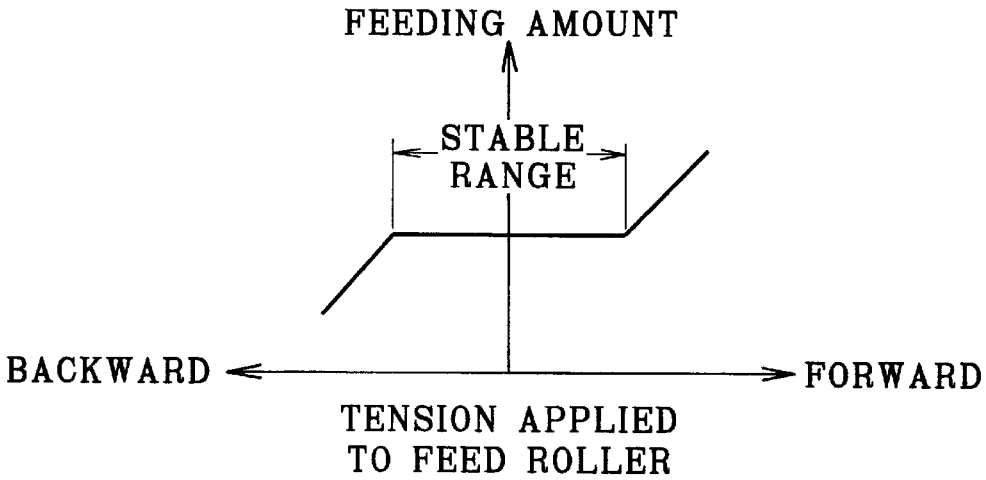
FIG. 6 is a graph illustrating a range where transport is stabilized.

In the above embodiment, the torque limiter 33, 64 is used to stabilize the transport of the continuous recording sheet 2, 61 the feed roller set 23. Furthermore, it is also possible to stabilize transport by keeping equilibrium between forward tension and back tension applied to the feed roller set 23. See the graph of FIG. 6. Another preferred embodiment for balancing the tension in two directions is hereinafter described. Elements similar to those of the above embodiment are designated with identical reference numerals.

Figure 7:
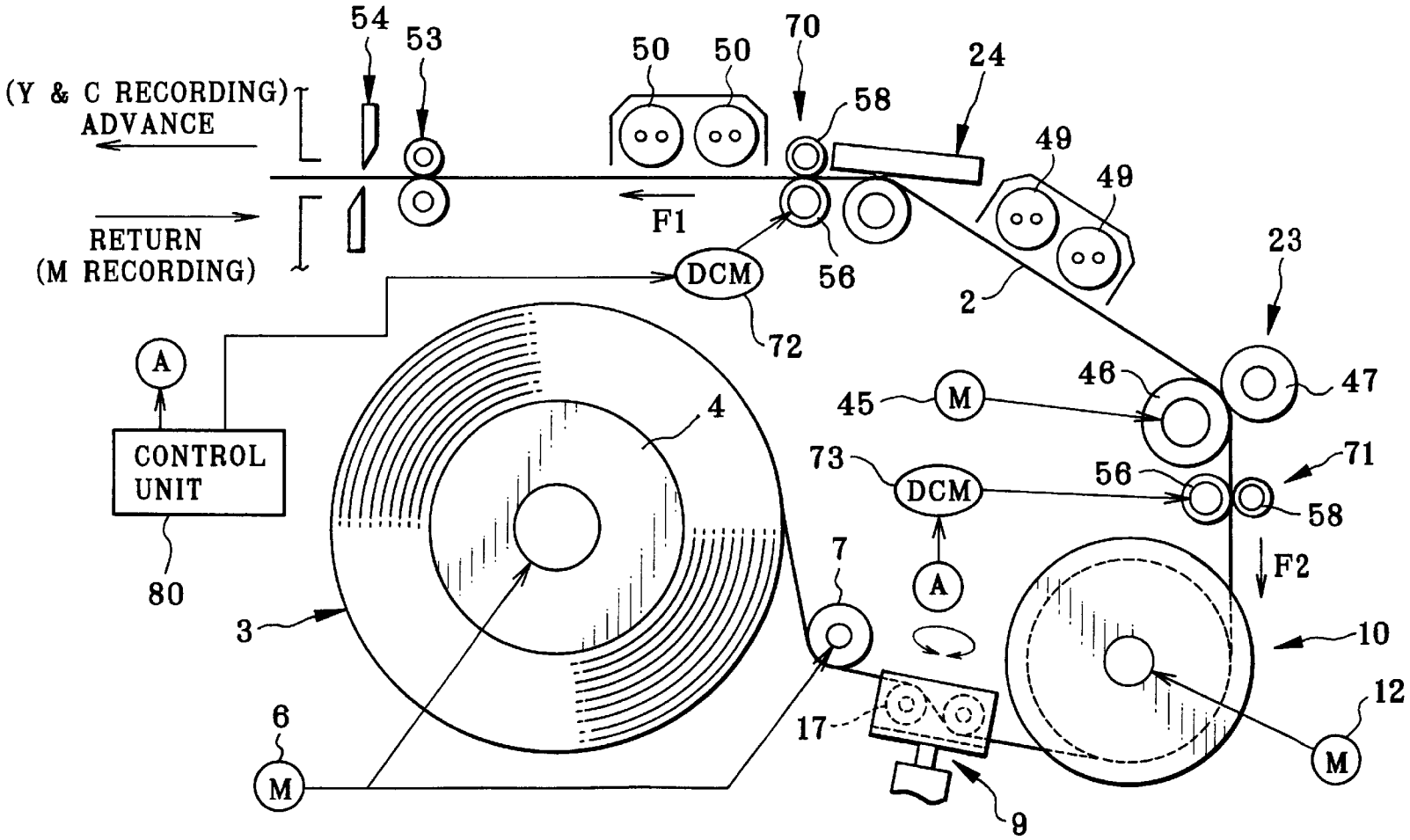
FIG. 7 is an explanatory view illustrating another preferred thermal printer having two sets of tension rollers.

In FIG. 7, a preferred color thermal printer is depicted. A tension roller set 70 is disposed in a position downstream from the thermal head 24. A tension roller set 71 is disposed in a position upstream from the feed roller set 23. Each of the tension roller sets 70 and 71 is a pair including the capstan roller 56 and the pinch roller 58. DC motors 72 and 73 as tension motors drive respectively the tension roller sets 70 and 71. A controller 80 controls the DC motors 72 and 73 to adjust torque applied by those to the capstan roller 56.

The yellow recording and cyan recording are effected in the course of transport in the advance direction. The tension roller set 70 driven by the DC motor 72 applies forward tension F1 to the continuous recording sheet 2. The forward tension F1 is sufficiently higher than resistance of the thermal head 24 to the continuous recording sheet 2 with friction. So the forward tension F1, if applied to the continuous recording sheet 2 in a free state, would result in a greater length of transport than the transport of the feed roller set 23. However, rotation of the feed roller set 23 determines the speed of the continuous recording sheet 2 in the section downstream from the feed roller set 23. In a manner irrespective of the torque applied to the tension roller set 70, the continuous recording sheet 2 is transported past the tension roller set 70 at the speed of the feed roller set 23.

Back tension F2 is applied by the tension roller set 71 to the continuous recording sheet 2. The back tension F2 of the tension roller set 71 is adjusted by controlling the torque of the DC motor 73, and set substantially equal to the forward tension F1. In short, the back tension F2 is in equilibrium with the forward tension F1. The forward tension F1 and the back tension F2 cancel each other, so that tension applied externally to the feed roller set 23 is reduced to substantially zero. As illustrated in a graph of FIG. 6, an amount of transport of the feed roller set 23 is kept in a stable range.

The magenta recording is effected in the course of transport in the return direction. The tension roller set 71 applies forward tension F2 to the continuous recording sheet 2. The tension roller set 70 applies back tension F1 to the continuous recording sheet 2. Also, in the returning transport, the forward tension F1 and the back tension F2 cancel each other, so that tension applied externally to the feed roller set 23 is reduced to substantially zero. Transport of the feed roller set 23 is maintained in the stable range with respect to the return direction. It follows that no shift of registration of the colors occurs, because the recording in the return direction can be effected in a manner of precisely determined positioning relative to the recording in the advance direction.

Figure 8:
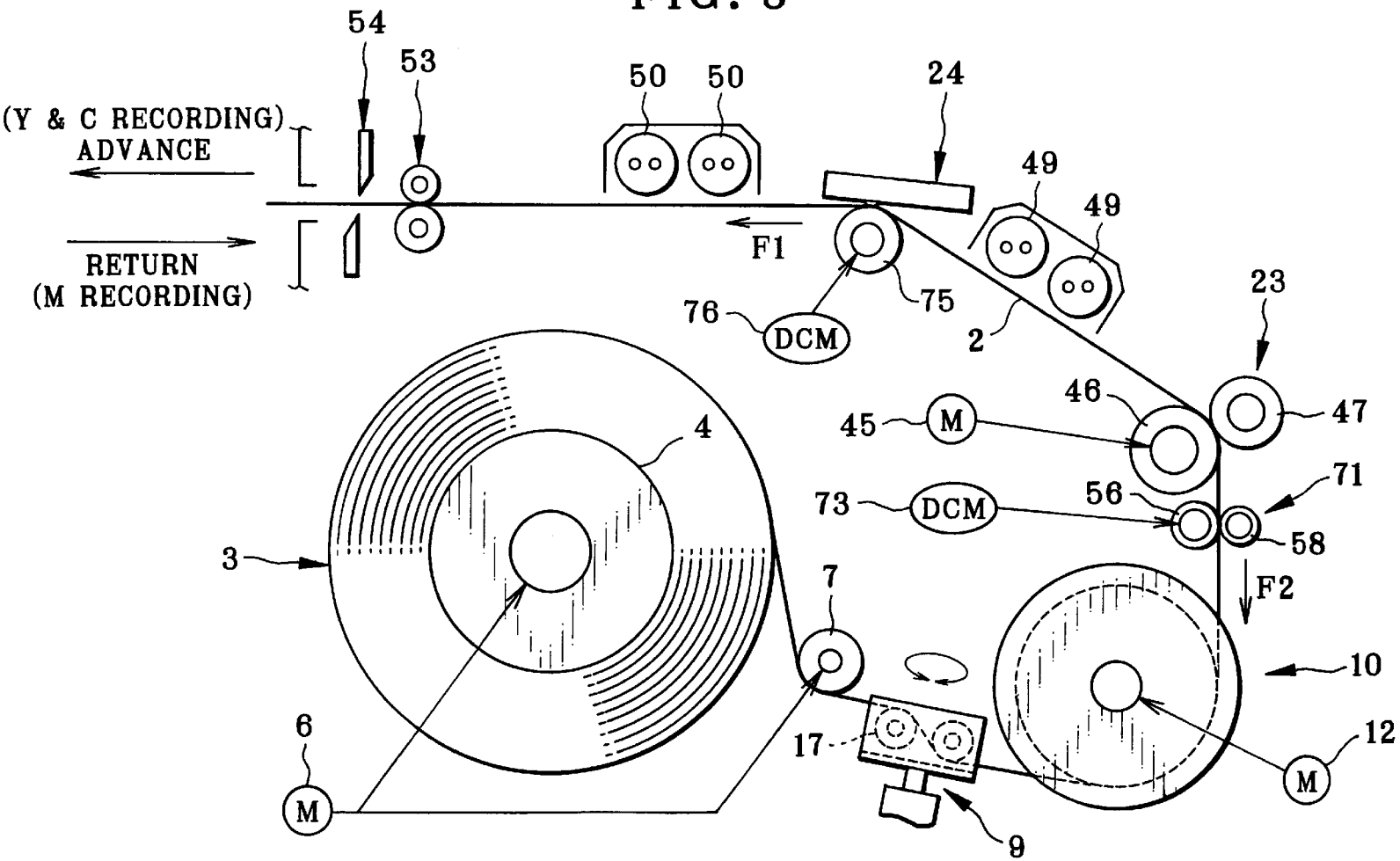
FIG. 8 is an explanatory view illustrating still another preferred thermal printer in which a platen roller generates tension.

Instead of the tension roller set 70 for applying tension, a platen roller 75 may apply tension to the continuous recording sheet 2. A preferred embodiment is illustrated in FIG. 8, in which a DC motor 76 as platen motor causes the platen roller 75 to rotate at a speed determined for applying suitable tension.

In the embodiment of FIG. 7, a torque limiter may be used in each of the tension roller sets 70 and 71 in a manner similar to that of FIG. 1. Also, a torque limiter may used in the embodiment of FIG. 8 for the similar purpose.

In the above embodiments, the tension rollers are rotated by the DC motor 57, 72, 73. The platen roller for tensioning is rotated by the DC motor 63, 76. Alternatively, tension rollers or platen roller may be rotated by use of stepping motors, or other suitable types of motors.

However, the use of the DC motors is still advantageous because of a low cost. The stepping motor 45 is effective to determine precise positioning of the continuous recording sheet 2 for the purpose of thermal recording line by line. In combination with the stepping motor 45, tension rollers or platen roller may be safely rotated by the DC motors having lower precision than the stepping motor 45.

In the above embodiments, the feed roller set 23 transports the continuous recording sheet 2 at such a speed as to determine a period of the thermal recording of each line, and therefore makes forward and backward rotations constantly at a regular rotational speed. The rotational speed of the feed roller set 23 and the transporting speed of the continuous recording sheet 2 are not influenced by elements related to the tension control according to the present invention, the elements including the tension roller set 26, 70, 71 and the platen roller 62, 75. For the purpose of this construction, roller diameters, roller pressure at which the continuous recording sheet 2 is nipped, and other values are predetermined to keep optimum correlations between the feed roller set 23 and the tension roller set 26, 70, 71.

In the above embodiment, a direct recording type of the color thermal printer is used. However, a printer of the invention may be a thermal transfer printer of any of suitable types, which may include a sublimation type, a wax transfer type and the like. In such types of printers, no optical fixer is required.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer for recording at least three color images to thermosensitive recording material according to frame sequential recording, said color thermal printer comprising:

a feed roller set, for transporting said recording material at a first speed back and forth by transport in first and second directions alternately;

a thermal head, positioned downstream from said feed roller set in said first direction, for recording said three color images according to said transport in both said first and second directions;

a first tension roller set, positioned downstream from said thermal head in said first direction, for applying tension to said recording material;

a first tension motor for driving said first tension roller set;

a controller for controlling a rotational speed of said first tension motor, for determining a transporting speed of said recording material with said first tension roller set higher than said first speed in said transport in said first direction, and for determining a transporting speed of said recording material with said first tension roller set lower than said first speed in said transport in said second direction; and a first torque limiter for adjusting transmission of rotation of said first tension motor to said first tension roller set, to keep a transporting speed of said recording material with said first tension roller set at said first speed during said transport in said first and second directions.

2. A color thermal printer as defined in claim 1, wherein said recording material is continuous thermosensitive recording material drawn from a recording material roll, said first direction is a direction of advancing from said recording material roll, and said second direction is a direction of returning to said recording material roll.

3. A color thermal printer as defined in claim 2, wherein, when load of a predetermined level is applied to said first tension roller set, said first torque limiter discontinues transmission of rotation of said first tension motor to said first tension roller set, and said predetermined level is higher than load of said thermal head in recording, and lower than transporting force of said feed roller set.

4. A color thermal printer as defined in claim 3, wherein said first tension roller set includes a first roller for being driven by said first tension motor, and a second roller for pressing said continuous recording material to said first roller.

5. A color thermal printer as defined in claim 4, further comprising a feeding motor, wherein said feed roller set includes a third roller for being driven by said feeding motor, and a fourth roller for pressing said continuous recording material to said third roller.

6. A color thermal printer as defined in claim 5, wherein said first tension motor is a DC motor, and said feeding motor is a stepping motor.

7. A color thermal printer as defined in claim 6, said first roller includes a roller body, and a shaft for supporting said roller body in a rotatable manner and for being driven by said DC motor;

said first torque limiter is a frictional clutch, secured to shaft, for frictional coupling with said roller body.

8. A color thermal printer as defined in claim 6, further comprising:

a second tension roller set, positioned upstream from said feed roller set in said first direction, for applying tension to said recording material;

a second tension motor for driving said second tension roller set;

a second torque limiter for adjusting transmission of rotation of said second tension motor to said second tension roller set, to keep a transporting speed of said recording material with said second tension roller set at said first speed during said transport in said first and second directions; and wherein said controller controls a rotational speed of said second tension motor, determines a transporting speed of said recording material with said second tension roller set lower than said first speed in said transport in said first direction, and determines a transporting speed of said recording material with said second tension roller set higher than said first speed in said transport in said second direction, whereby said first and second tension roller sets apply force to said continuous recording material at an equal level but in directions opposite to one another.

9. A color thermal printer for recording at least three color images to thermosensitive recording material according to frame sequential recording, said color thermal printer comprising:

a feed roller set, for transporting said recording material at a first speed back and forth by transport in first and second directions alternately;

a thermal head, positioned downstream from said feed roller set in said first direction, for recording said three color images according to said transport in both said first and second directions;

a platen roller for supporting said recording material pressed by said thermal head;

a platen motor for driving said platen roller;

a controller for controlling a rotational speed of said platen motor, for determining a transporting speed of said recording material with said platen roller higher than said first speed in said transport in said first direction, and for determining a transporting speed of said recording material with said platen roller lower than said first speed in said transport in said second direction; and a first torque limiter for adjusting transmission of rotation of said platen motor to said platen roller, to keep a transporting speed of said recording material with said platen roller at said first speed during said transport in said first and second directions.

10. A color thermal printer as defined in claim 9, wherein said recording material is continuous thermosensitive recording material drawn from a recording material roll, said first direction is a direction of advancing from said recording material roll, and said second direction is a direction of returning to said recording material roll.

11. A color thermal printer as defined in claim 10, wherein, when load of a predetermined level is applied to said platen roller, said first torque limiter discontinues transmission of rotation of said platen motor to said platen roller, and said predetermined level is higher than load of said thermal head in recording, and lower than transporting force of said feed roller set.

12. A color thermal printer as defined in claim 11, further comprising a feeding motor, wherein said feed roller set includes a first roller for being driven by said feeding motor, and a second roller for pressing said continuous recording material to said first roller.

13. A color thermal printer as defined in claim 12, wherein said platen motor is a DC motor, and said feeding motor is a stepping motor.

14. A color thermal printer as defined in claim 13, further comprising:

a tension roller set, positioned upstream from said feed roller set in said first direction, for applying tension to said recording material;

a tension motor for driving said tension roller set;

a second torque limiter for adjusting transmission of rotation of said tension motor to said tension roller set, to keep a transporting speed of said recording material with said tension roller set at said first speed during said transport in said first and second directions; and wherein said controller controls a rotational speed of said tension motor, determines a transporting speed of said recording material with said tension roller set lower than said first speed in said transport in said first direction, and determines a transporting speed of said recording material with said tension roller set higher than said first speed in said transport in said second direction, whereby said platen roller and said tension roller set apply force to said continuous recording material at an equal level but in directions opposite to one another.

15. A color thermal printer for recording at least three color images to thermosensitive recording material according to frame sequential recording, said color thermal printer comprising:

a feed roller set, for transporting said recording material at a first speed back and forth by transport in first and second directions alternately;

a thermal head, positioned downstream from said feed roller set in said first direction, for recording said three color images according to said transport in both said first and second directions;

a first tension roller set, positioned downstream from said thermal head in said first direction, for applying tension to said recording material;

a first tension motor for driving said first tension roller set, a rotational speed of said first tension motor being changeable with an increase or decrease according to a transporting speed of said recording material;

a second tension roller set, positioned upstream from said feed roller set in said first direction, for applying tension to said recording material;

a second tension motor for driving said second tension roller set, a rotational speed of said second tension motor being changeable with an increase or decrease according to a transporting speed of said recording material; and a controller for controlling said rotational speeds of said first and second tension motors;

wherein in a first process of said transport in said first direction, said controller adjusts said rotational speed of said first tension motor to determine a transporting speed of said recording material with said first tension roller set higher than said first speed, and adjusts said rotational speed of said second tension motor to determine a transporting speed of said recording material with said second tension roller set lower than said first speed, said first tension roller set creates forward tension to pull said recording material in said first direction, said second tension roller set creates back tension to pull said recording material in said second direction, said back tension is substantially equal to said forward tension;

wherein in a second process of said transport in said second direction, said controller adjusts said rotational speed of said first tension motor to determine a transporting speed of said recording material with said first tension roller set lower than said first speed, and adjusts said rotational speed of said second tension motor to determine a transporting speed of said recording material with said second tension roller set higher than said first speed, said second tension roller set creates forward tension to pull said recording material in said second direction, said first tension roller set creates back tension to pull said recording material in said first direction, said back tension is substantially equal to said forward tension.

16. A color thermal printer as defined in claim 15, wherein said recording material is continuous thermosensitive recording material drawn from a recording material roll, said first direction is a direction of advancing from said recording material roll, and said second direction is a direction of returning to said recording material roll.

17. A color thermal printer as defined in claim 16, wherein each of said first and second tension roller sets includes a first roller for being driven by said first or second tension motor, and a second roller for pressing said continuous recording material to said first roller.

18. A color thermal printer as defined in claim 17, further comprising a feeding motor, wherein said feed roller set includes a third roller for being driven by said feeding motor, and a fourth roller for pressing said continuous recording material to said third roller.

19. A color thermal printer as defined in claim 18, wherein said first and second tension motors are DC motors, and said feeding motor is a stepping motor.

20. A color thermal printer for recording at least three color images to thermosensitive recording material according to frame sequential recording, said color thermal printer comprising:

a feed roller set, for transporting said recording material at a first speed back and forth by transport in first and second directions alternately;

a thermal head, positioned downstream from said feed roller set in said first direction, for recording said three color images according to said transport in both said first and second directions;

a platen roller for supporting said recording material pressed by said thermal head;

a platen motor for driving said platen roller, a rotational speed of said platen motor being changeable with an increase or decrease according to a transporting speed of said recording material;

a tension roller set, positioned upstream from said feed roller set in said first direction, for applying tension to said recording material;

a tension motor for driving said tension roller set, a rotational speed of said tension motor being changeable with an increase or decrease according to a transporting speed of said recording material; and a controller for controlling said rotational speeds of said platen motor and said tension motor;

wherein in a first process of said transport in said first direction, said controller adjusts said rotational speed of said platen motor to determine a transporting speed of said recording material with said platen roller higher than said first speed, and adjusts said rotational speed of said tension motor to determine a transporting speed of said recording material with said tension roller set lower than said first speed, said platen roller creates forward tension to pull said recording material in said first direction, said tension roller set creates back tension to pull said recording material in said second direction, said back tension is substantially equal to said forward tension;

wherein in a second process of said transport in said second direction, said controller adjusts said rotational speed of said platen motor to determine a transporting speed of said recording material with said platen roller lower than said first speed, and adjusts said rotational speed of said tension motor to determine a transporting speed of said recording material with said tension roller set higher than said first speed, said tension roller set creates forward tension to pull said recording material in said second direction, said platen roller creates back tension to pull said recording material in said first direction, said back tension is substantially equal to said forward tension.

21. A color thermal printer as defined in claim 20, wherein said recording material is continuous thermosensitive recording material drawn from a recording material roll, said first direction is a direction of advancing from said recording material roll, and said second direction is a direction of returning to said recording material roll.

22. A color thermal printer as defined in claim 21, wherein said tension roller set includes a first roller for being driven by said tension motor, and a second roller for pressing said continuous recording material to said first roller.

23. A color thermal printer as defined in claim 22, further comprising a feeding motor, wherein said feed roller set includes a third roller for being driven by said feeding motor, and a fourth roller for pressing said continuous recording material to said third roller.

24. A color thermal printer as defined in claim 23, wherein said platen motor and said tension motor are DC motors, and said feeding motor is a stepping motor.

* * * * *